US012800149B2

(12) United States Patent
Xiao et al.

(10) Patent No.: US 12,800,149 B2
(45) Date of Patent: Nov. 17, 2026

(54) FIRE PIT

(71) Applicants: Shenzhen Ruisi Jichuang Technology Limited, Shenzhen (CN); Heye Xiao, Xi'an (CN); Hui Wang, Xianyang (CN)

(72) Inventors: Heye Xiao, Xi'an (CN); Hui Wang, Xianyang (CN)

(73) Assignee: Ningbo Raise Technology Co., Ltd., Ningbo (CN)

( * ) Notice: Subject to any disclaimer, the term of this patent is extended or adjusted under 35 U.S.C. 154(b) by 1000 days.

(21) Appl. No.: 17/942,187

(22) Filed: Sep. 12, 2022

(65) Prior Publication Data

US 2024/0085026 A1 Mar. 14, 2024

(51) Int. Cl.

*F24B 5/00* (2006.01)
*F24B 5/02* (2006.01)
*F24B 13/00* (2006.01)

(52) U.S. Cl.

CPC ..... *F24B 5/026* (2013.01); *F24B 13/008* (2013.01)

(58) Field of Classification Search

CPC ..... F24B 5/00; F24B 5/026; F24B 13/008; F24B 1/19; F24B 1/181

See application file for complete search history.

(56) References Cited

U.S. PATENT DOCUMENTS

| | | | | |
|---|---|---|---|---|
| 10,746,408 | B1 * | 8/2020 | Goin | F24B 5/028 |
| 11,391,465 | B1 * | 7/2022 | Weilert | F24B 1/18 |
| 11,774,089 | B1 * | 10/2023 | Weilert | F23B 1/26 |
| 12,000,592 | B1 * | 6/2024 | Ressler | F24B 3/00 |
| 2015/0327723 | A1 * | 11/2015 | Leighton | A47J 37/0704 |
| 2017/0114996 | A1 * | 4/2017 | Moneyhun | F23C 1/04 |
| 2018/0051886 | A1 * | 2/2018 | Myers | F24B 5/023 |
| 2021/0046188 | A1 | 2/2021 | Hucknall et al. | |
| 2021/0048188 | A1 * | 2/2021 | Harrington | F23B 20/00 |

FOREIGN PATENT DOCUMENTS

DE 20 2018 107 261 * 12/2018 ..... F24B 3/00

OTHER PUBLICATIONS

English prior art DE 20 2018 107 261.*

* cited by examiner

*Primary Examiner* — Gregory A Wilson
(74) *Attorney, Agent, or Firm* — Calfee, Halter & Griswold LLP

(57) ABSTRACT

A fire pit includes a main body. The main body has a combustion chamber and an air passage communicating with the combustion chamber. The surface of the inner side of the air passage, close to the combustion chamber, has a plurality of vortex-generating portions. The fire pit can improve the temperature and the inflow of the air entering the combustion chamber from the air passage, thereby improving the combustion efficiency of the fuel burned in the combustion chamber effectively.

15 Claims, 7 Drawing Sheets

FIRE PIT

BACKGROUND OF THE INVENTION

1. Field of the Invention

The present invention relates to a warming and heating device, and more particularly to a fire pit.

2. Description of the Prior Art

A fire pit is widely used as a warming and heating device. When in use, a fuel (such as firewood, straw) is put inside the fire pit and the fuel is burned. In order to improve the combustion efficiency of the fuel, the existing fire pit has an air passage for the external air to enter the fire pit, so as to improve the combustion efficiency of the fuel. However, this existing fire pit still has a problem, that is, the air entering the fire pit from the air passage to be in contact with the fuel has a low temperature and a small flow rate, which cannot improve the combustion efficiency of the fuel well.

SUMMARY OF THE INVENTION

The primary object of the present invention is to provide a fire pit to overcome the deficiencies of the prior art.

In order to achieve the above-mentioned object, the present invention adopts the following solutions.

A fire pit comprises a main body. The main body has a main body inner wall, a main body outer wall disposed outside the main body inner wall, and a main body top plate connecting a top peripheral edge of the main body inner wall and a top peripheral edge of the main body outer wall. A combustion chamber is formed inside the main body inner wall. An air passage is formed among the main body inner wall, the main body outer wall and the main body top plate. A top and a peripheral side of the air passage are closed. A lower portion of the main body outer wall has a plurality of air inlets communicating with the air passage. An upper portion of the main body inner wall has a plurality of air vents communicating with the air passage and the combustion chamber. The air vents are located higher than the air inlets. An outer surface of the main body inner wall has a plurality of vortex-generating portions.

Preferably, the vortex-generating portions include at least one of recesses and protrusions.

Preferably, the main body further includes a main body inner bottom plate and a main body outer bottom plate. The main body inner wall and the main body outer wall each have a ring shape. The main body outer wall is sleeved on the main body inner wall. The main body inner bottom plate is connected to a bottom peripheral edge of the main body inner wall. The main body outer bottom plate is connected to a lower peripheral edge of the main body outer wall. The combustion chamber is formed between the main body inner wall and the main body inner bottom plate. The air passage is formed among the main body outer wall, the main body inner wall, the main body top plate and the main body outer bottom plate.

Preferably, the fire pit further comprises an ash-receiving device. The ash-receiving device includes an ash-receiving cylinder with an upper opening. The ash-receiving cylinder is accommodated in the main body and located between the main body inner bottom plate and the main body outer bottom plate. An inner chamber of the ash-receiving cylinder and the air passage are independent of each other. The main body inner bottom plate has a plurality of perforations.

The inner chamber of the ash-receiving cylinder communicates with the combustion chamber via the perforations.

Preferably, the ash-receiving device further includes an ash-receiving tray with an upper opening. The ash-receiving tray is accommodated in the ash-receiving cylinder. The ash-receiving tray is suspended relative to the ash-receiving cylinder.

Preferably, an outer side of the ash-receiving tray is connected to an inner side of the ash-receiving cylinder through a plurality of connecting legs.

Preferably, the ash-receiving cylinder is suspended relative to the main body outer bottom plate.

Preferably, the main body outer wall includes an upper main body outer wall and a lower main body outer wall that are detachably connected. The lower main body outer wall has the air inlets. The ash-receiving cylinder is connected to the lower main body outer wall through an annular connecting plate. The connecting plate has a plurality of air holes.

Preferably, the upper main body outer wall is connected to the main body inner wall through a plurality of connecting blocks. The connecting blocks are arranged at intervals.

Preferably, a bottom of the upper main body outer wall abuts against the connecting plate. A restricting sleeve is connected to a top of the lower main body outer wall. The restricting sleeve is fitted on the upper main body outer wall.

Preferably, the upper main body outer wall is formed with a curved reinforcing portion.

Preferably, a top peripheral edge of the ash-receiving cylinder abuts against a bottom peripheral edge of the main body inner wall.

Alternatively, a top peripheral edge of the ash-receiving cylinder is connected to a bottom peripheral edge of the main body inner wall.

Preferably, the fire pit further comprises an adjusting ring. The adjusting ring is rotatably sleeved on the main body outer wall. The adjusting ring has a plurality of adjusting holes. The adjusting holes of the adjusting ring are movably aligned with the air inlets of the main body outer wall, respectively.

Preferably, the fire pit further comprises a top cover. The top cover is a hollow structure. The top cover has an upper opening and a lower opening. The upper opening has a diameter less than that of the lower opening. A bottom of the top cover abuts against the main body top plate.

After adopting the above solutions, the present invention has the following features.

1. When in use, the fuel is placed in the combustion chamber for burning. The external air enters the air passage via the air inlets and then enters the combustion chamber from the air vents, so as to facilitate the combustion of the fuel. After the fuel is burned, the main body inner wall is heated to heat the air entering the air passage. The heated air enters the combustion chamber from the air vents to facilitate the combustion of the fuel. The temperature difference between the heated air and the interior of the combustion chamber is less, which accelerates the drying, ignition and combustion of the fuel, ensures the stable combustion of the fuel in the main body and improves the combustion efficiency of the fuel. After the fuel is burned, the temperature of the upper portion of the combustion chamber is higher so that the temperature of the upper portion of the air passage is higher than that of the lower portion of the air passage. The convection effect in the air passage is strong, so that the air flow velocity at the air inlets is fast and the air flow in the air passage is increased, thereby increasing the amount of air entering the combustion chamber to further improve the combustion efficiency.

2. In the present invention, the outer surface of the main body inner wall has a plurality of vortex-generating portions. Compared with the fire pit inner wall having a flat outer surface, the main body inner wall having the vortex-generating portions on the outer surface has a larger outer surface area, so that the contact area between the main body inner wall and the air entering the air passage is large. Besides, the vortex-generating portions of the main body inner wall will destroy the boundary layer of the air in the air passage, so that the air in the air passage will form a vortex at the vortex-generating portions to increase the stay time of the air in the air passage. In this way, the heating effect of the main body inner wall on the air entering the air passage is improved, so that the temperature difference between the air entering the combustion chamber from the air vents and the interior of the combustion chamber is less, which can further improve the combustion efficiency of the fuel.
3. In the present invention, the vortex-generating portions of the main body inner wall include at least one of recesses and protrusions. The temperature of the vortex-generating portions in the form of recesses is higher, and the heat conduction effect to the air in the air passage is better. The vortex-generating portions in the form of protrusions is closer to the main body outer wall, so that vortex-generating portions in the form of protrusions and the main body outer wall have better heat radiation effect, which is beneficial to improve the warming effect on the side of the main body.

DETAILED DESCRIPTION OF THE PREFERRED EMBODIMENTS

Figure 1:
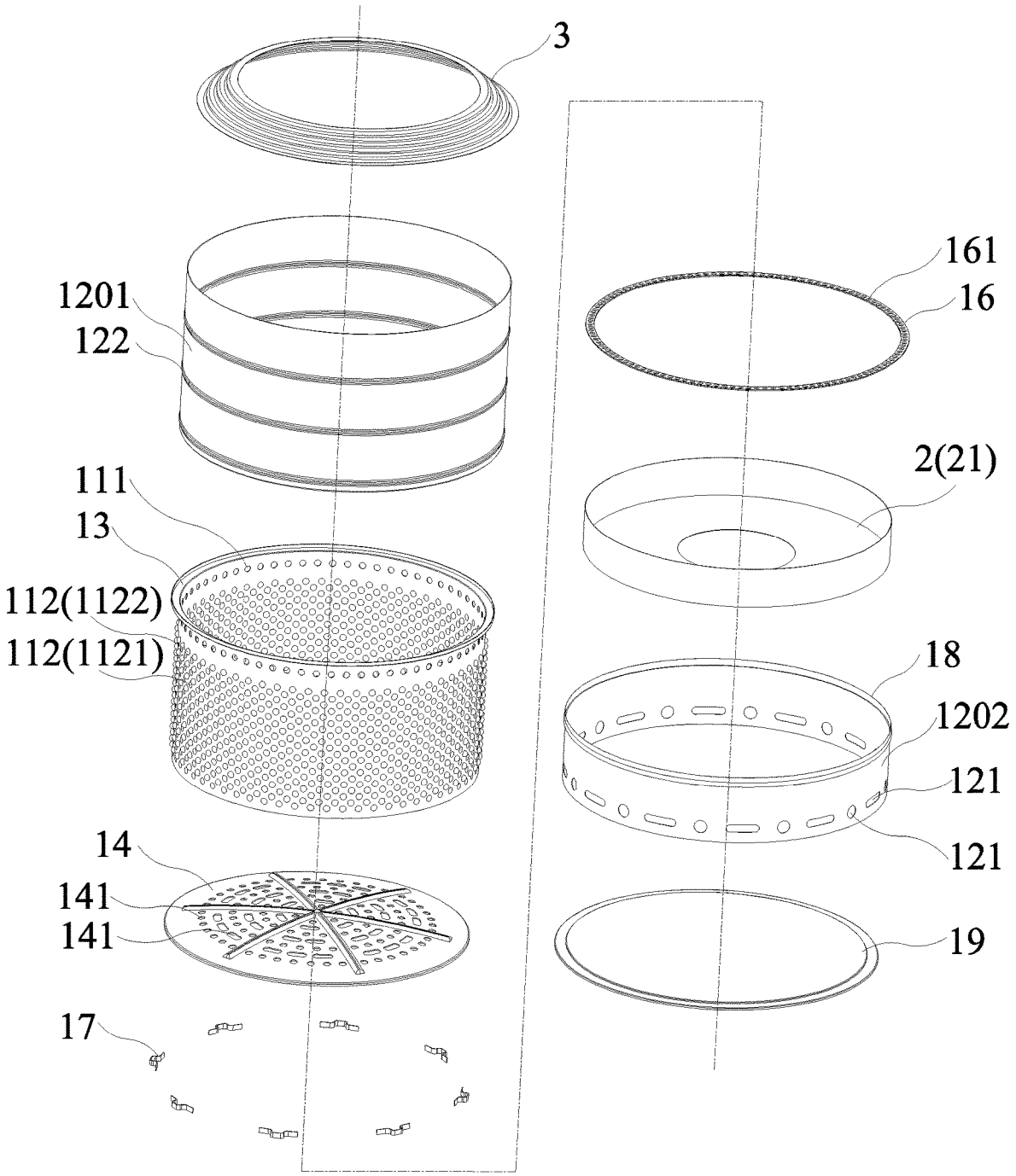
FIG. 1 is an exploded view according to an exemplary embodiment of the present invention.
Figure 2:
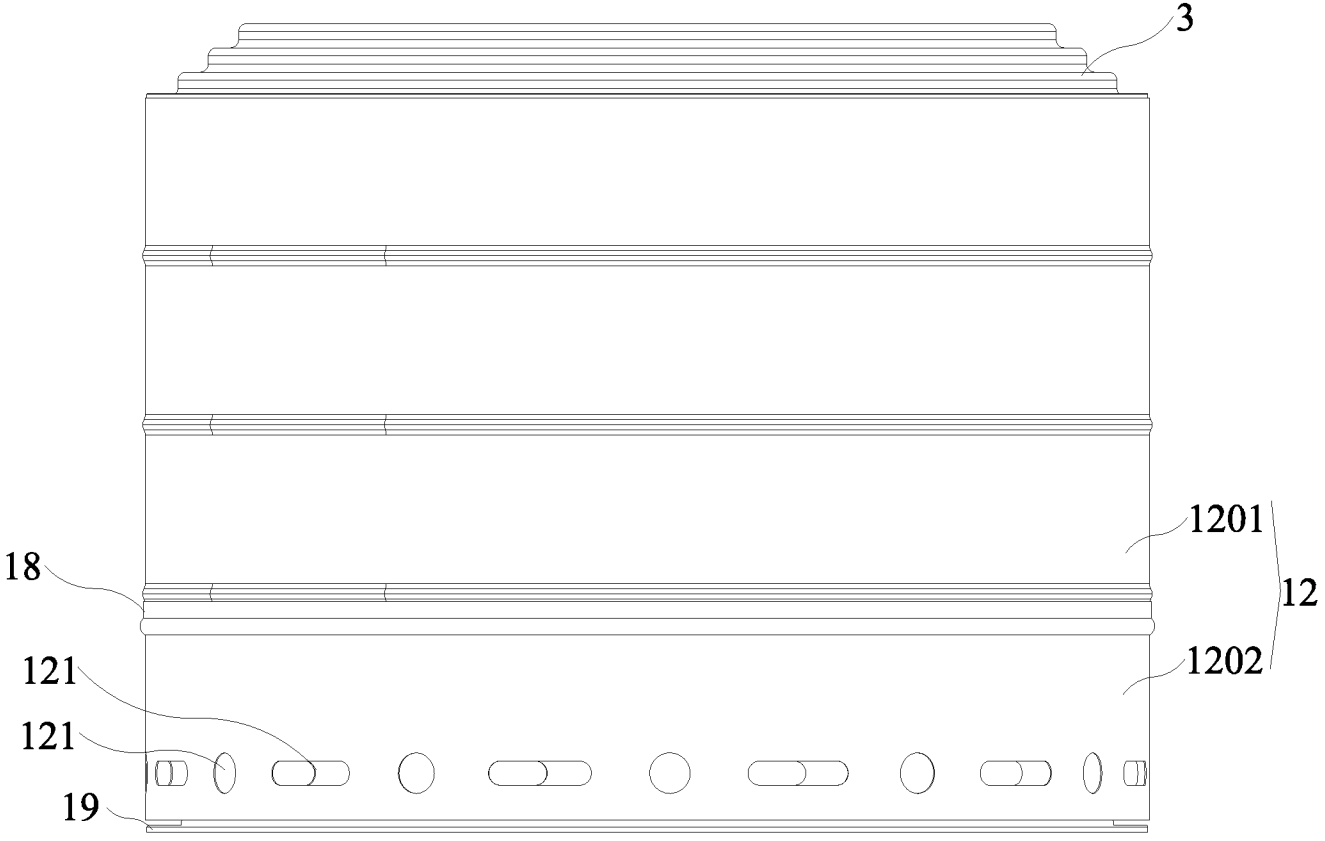
FIG. 2 is a front view according to the exemplary embodiment of the present invention.

In order to further explain the technical solutions of the present invention, embodiments of the present invention will now be described, by way of example only, with reference to the accompanying drawings.

As shown in FIGS. 1 to 7, the present invention discloses a fire pit, comprising a main body 1. The main body 1 has a main body inner wall 11, a main body outer wall 12 disposed outside the main body inner wall 11, and a main body top plate 13 connecting the top peripheral edge of the main body inner wall 11 and the top peripheral edge of the main body outer wall 12. A combustion chamber S1 is formed inside the main body inner wall 11. An air passage S2 is formed among the main body inner wall 11, the main body outer wall 12 and the main body top plate 13. The top and the peripheral side of the air passage S2 are closed. The lower portion of the main body outer wall 12 has a plurality of air inlets 121 communicating with the air passage S2. The upper portion of the main body inner wall 11 has a plurality of air vents 111 communicating with the air passage S2 and the combustion chamber S1. The air vents 111 are located higher than the air inlets 121. When the main body 1 is in use, the bottom of the air passage S2 is also closed. If the bottom of the air passage S2 is open, the air passage S2 can be closed by the ground. When in use, the fuel is placed in the combustion chamber S1 for burning. The external air will enter the air passage S2 via the air inlets 121 and then enter the combustion chamber S1 from the air vents 111, so as to facilitate the combustion of the fuel. After the fuel is burned, the main body inner wall 11 is heated to heat the air entering the air passage S2. The heated air enters the combustion chamber S1 from the air vents 111 to facilitate the combustion of the fuel. The temperature difference between the heated air and the interior of the combustion chamber S1 is less, which accelerates the drying, ignition and combustion of the fuel, ensures the stable combustion of the fuel in the main body 1 and improves the combustion efficiency of the fuel. After the fuel is burned, the temperature of the upper portion of the combustion chamber S1 is higher so that the temperature of the upper portion of the air passage S2 is higher than that of the lower portion of the air passage S2. The convection effect in the air passage S2 is strong, so that the air flow velocity at the air inlets 121 is fast and the air flow in the air passage S2 is increased, thereby increasing the amount of air entering the combustion chamber S1 to further improve the combustion efficiency.

In the present invention, the outer surface of the main body inner wall 11 has a plurality of vortex-generating portions 112, that is, a plurality of vortex-generating portions 112 are disposed on the surface of the inner side of the air passage S2 close to the combustion chamber S1. Compared with the main body inner wall 11 having a flat outer surface, the main body inner wall 11 having the vortex-generating portions 112 on the outer surface has a larger outer surface area, so that the contact area between the main body inner wall 11 and the air entering the air passage S2 is large. Besides, the vortex-generating portions 112 of the main body inner wall 11 will destroy the boundary layer of the air in the air passage S2, so that the air in the air passage S2 will form a vortex at the vortex-generating portions 112 to increase the stay time of the air in the air passage S2. In this way, the heating effect of the main body inner wall 11 on the air entering the air passage S2 is improved, so that the temperature difference between the air entering the combustion chamber S1 from the air vents 111 and the interior of the combustion chamber S1 is less, which further improves the combustion efficiency of the fuel.

As shown in FIGS. 1 to 7, in the present invention, the main body inner wall 11 and the main body outer wall 12 each have a ring shape, such as a circle, square or cone. The main body outer wall 12 is sleeved on the main body inner wall 11. The main body 1 may further include a main body inner bottom plate 14 and a main body outer bottom plate 15. The main body inner bottom plate 14 is connected to the bottom peripheral edge of the main body inner wall 11. The main body outer bottom plate 15 is connected to the lower peripheral edge of the main body outer wall 12. The combustion chamber S1 is formed between the main body inner wall 11 and the main body inner bottom plate 14. The air passage S2 is formed among the main body outer wall 12, the main body inner wall 11, the main body top plate 13 and the main body outer bottom plate 15, so that the air passage S2 has an annular configuration.

As shown in FIGS. 1 to 7, the fire pit of the present invention further comprises an ash-receiving device 2. The ash-receiving device 2 is configured to receive the ash produced after the fuel is burned. The ash-receiving device 2 includes an ash-receiving cylinder 21 having an upper opening. The ash-receiving cylinder 21 is accommodated in the main body 1 and is located between the main body inner bottom plate 14 and the main body outer bottom plate 15. The main body inner bottom plate 14 has a plurality of perforations 141. The inner chamber of the ash-receiving cylinder 21 communicates with the combustion chamber S1 via the perforations 141. The ash produced by the combustion of the fuel in the combustion chamber S1 will fall into the ash-receiving cylinder 21 from the perforations 141. The arrangement of the ash-receiving cylinder 21 can increase the contact area between the fuel and the air, so that the fuel is bunted more fully. The inner chamber of the ash-receiving cylinder 21 and the air passage S2 are independent of each other, so as to prevent the ash-receiving cylinder 21 from affecting air circulation in the air passage S2. The ash-receiving cylinder 21 is suspended relative to the main body outer bottom plate 15, thereby reducing the heat conduction between the ash-receiving cylinder 21 and the main body outer bottom plate 15, so as to prevent overheating of the main body outer bottom plate 15.

Figure 6:
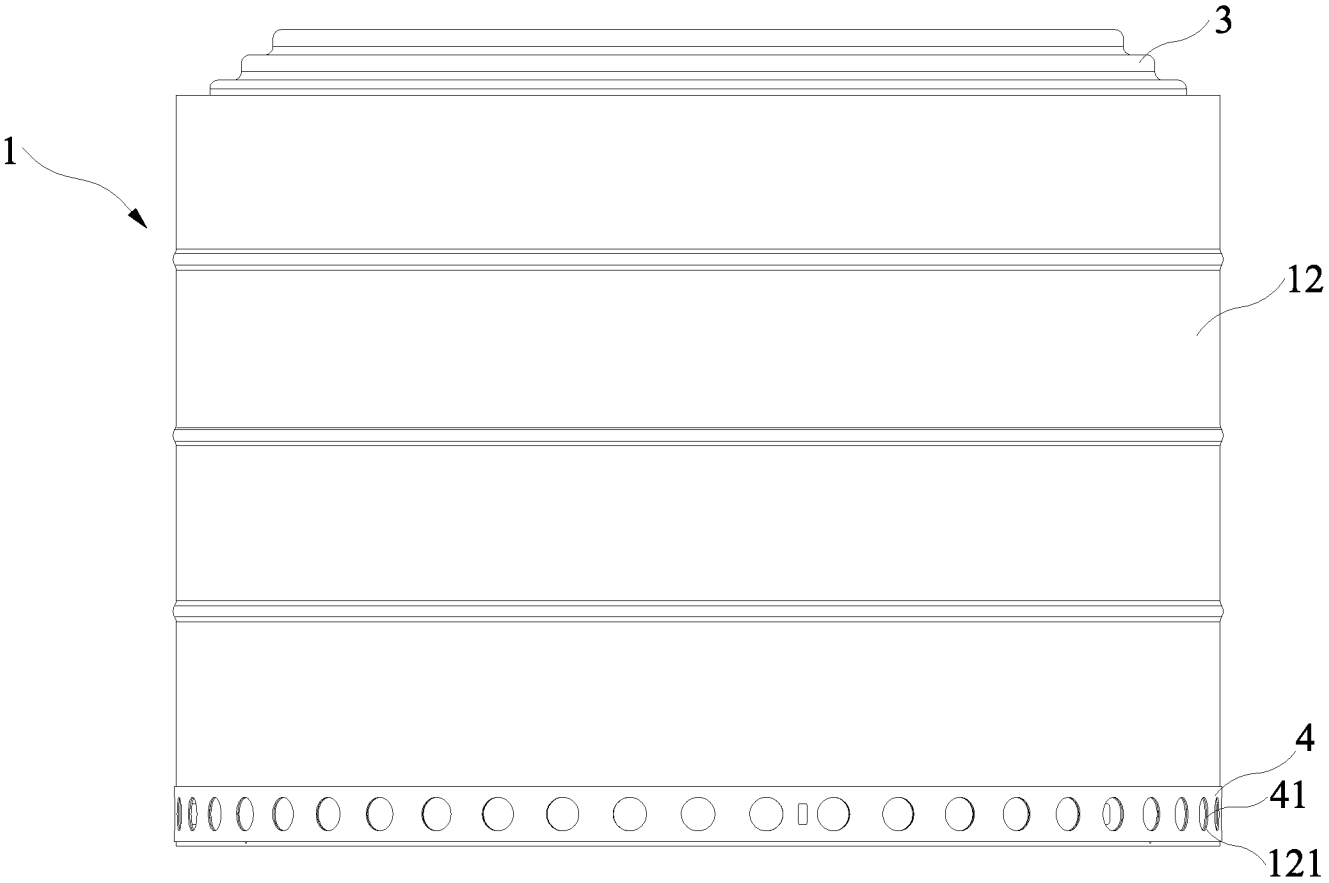
FIG. 6 is a front view according to another exemplary embodiment of the present invention.
Figure 7:
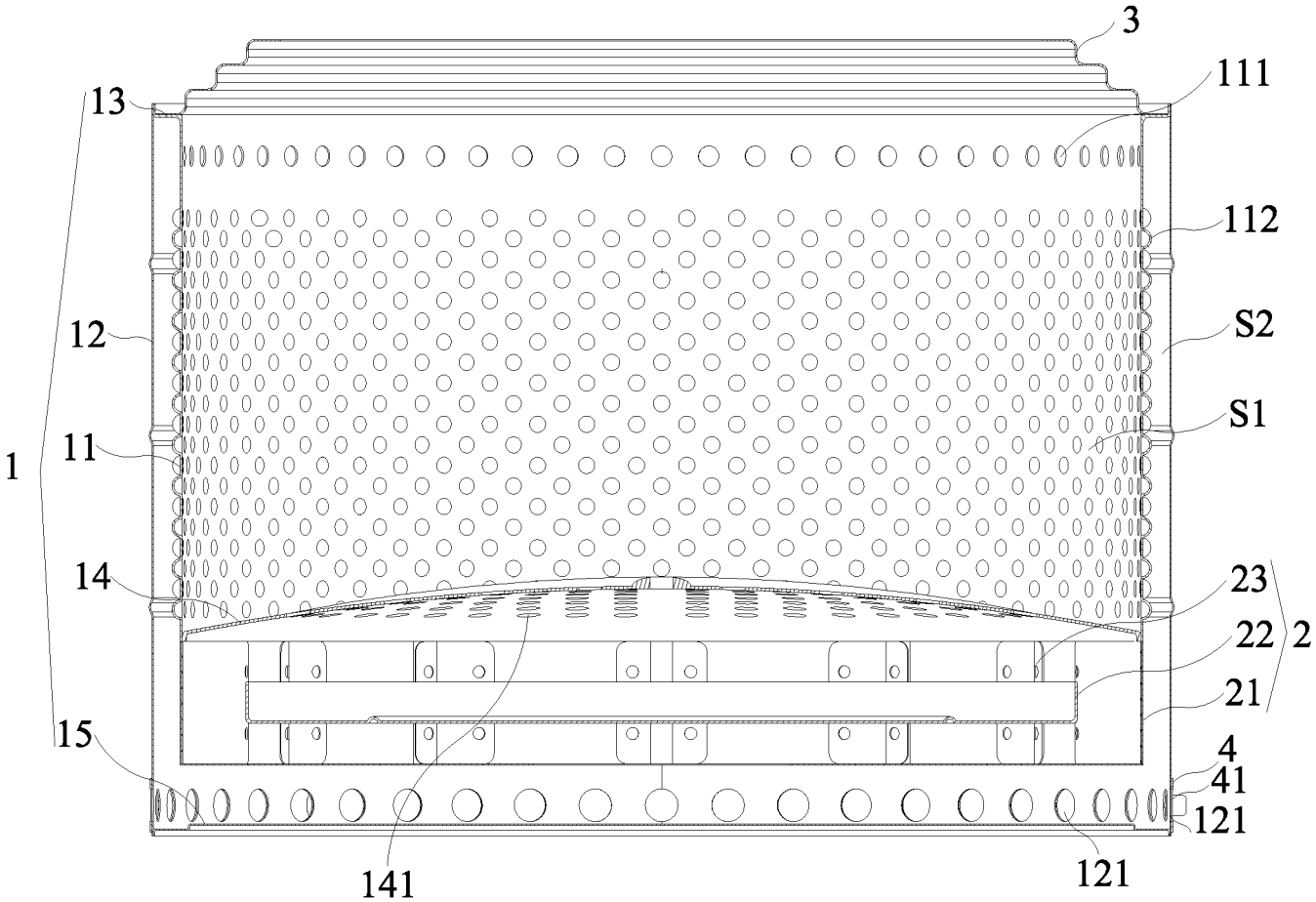
FIG. 7 is a cross-sectional view according to another exemplary embodiment of the present invention.

As shown in FIG. 6 and FIG. 7, the ash-receiving device 2 may further include an ash-receiving tray 22 with an upper opening. The ash-receiving tray 22 is accommodated in the ash-receiving cylinder 21. The ash-receiving tray 22 is suspended relative to the ash-receiving cylinder 21 to reduce the heat conduction between the ash-receiving cylinder 21 and the ash-receiving tray 22. The ash produced by the combustion of the fuel in the combustion chamber S1 will fall into the ash-receiving tray 22 from the perforations 141, so that the temperature of the ash-receiving cylinder 21 can be lowered. The outer side of the ash-receiving tray 22 is connected to the inner side of the ash-receiving cylinder 21 through a plurality of connecting legs 23, so that the ash-receiving tray 22 is suspended relative to the ash-receiving cylinder 21.

As shown in FIGS. 1 to 7, the fire pit of the present invention further comprises a top cover 3. The top cover 3 is a hollow structure. The top cover 3 has an upper opening and a lower opening. The diameter of the upper opening is less than the diameter of the lower opening. The bottom of the top cover 3 abuts against the main body top plate 13. The top cover 3 is configured to prevent the ash from flying after the fuel is burned.

Figure 3:
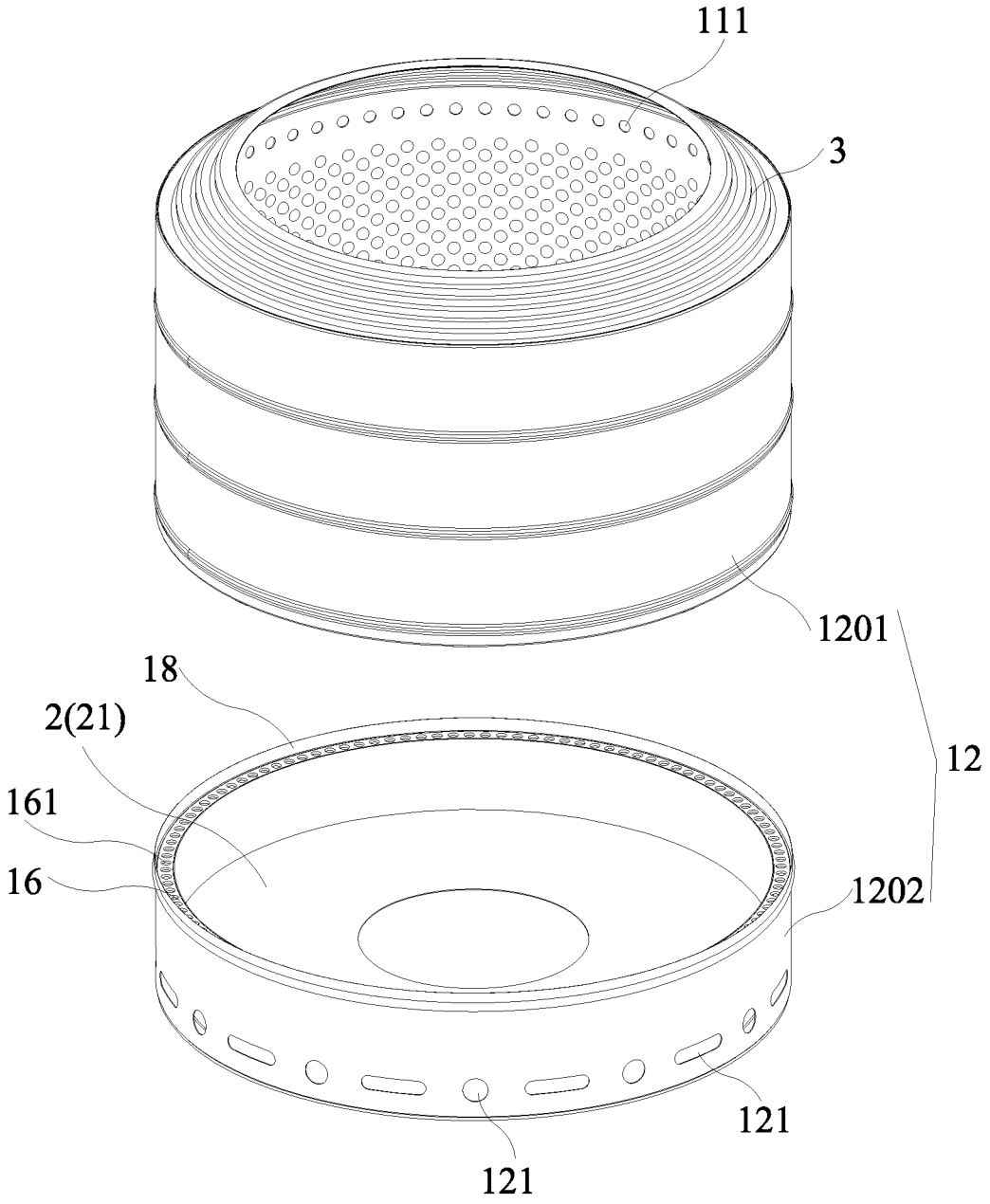
FIG. 3 is a partial exploded view according to the exemplary embodiment of the present invention.

As shown in FIGS. 1 to 5, in an exemplary embodiment of the present invention, the fire pit of the present invention may be a detachable structure after being assembled. Specifically, in an exemplary embodiment of the present invention, the main body outer wall 12 includes an upper main body outer wall 1201 and a lower main body outer wall 1202 that are detachably connected. The lower main body outer wall 1202 has the air inlets 121. The air inlets 121 include round holes and elongated holes. The ash-receiving cylinder 21 is connected to the lower main body outer wall 1202 through an annular connecting plate 16. The connecting plate 16 has a plurality of air holes 161 for the air to pass through the air passage S2. The main body inner wall 11 and the main body top plate 13 are integrally formed. The main body inner wall 11 and the main body inner bottom plate 14 are connected by welding. The main body top plate 13 and the upper main body outer wall 1201 are connected by welding. The main body outer bottom plate 15 and the lower main body outer wall 1202 may be integrally formed. The bottom of the main body outer bottom plate 15 may be welded with a support seat 19 for the main body 1 to be placed stably. The top peripheral edge of the ash-receiving cylinder 21 abuts against the bottom peripheral edge of the main body inner wall 11 so that the inner chamber of the ash-receiving cylinder 21 and the air passage S2 are independent of each other. Referring to FIG. 3, the fire pit of the present invention includes two parts that can be disassembled and assembled after assembly. One part includes the main body inner wall 11, the upper main body outer wall 1201, the main body top plate 13 and the main body inner bottom plate 14. The other part includes the lower main body outer wall 1202, the connecting plate 16, the main body outer bottom plate 15, the ash-receiving cylinder 21 and the support seat 19. In this way, the two parts can be disassembled so that the ash in the ash-receiving cylinder 21 can be poured out with ease.

Figure 4:
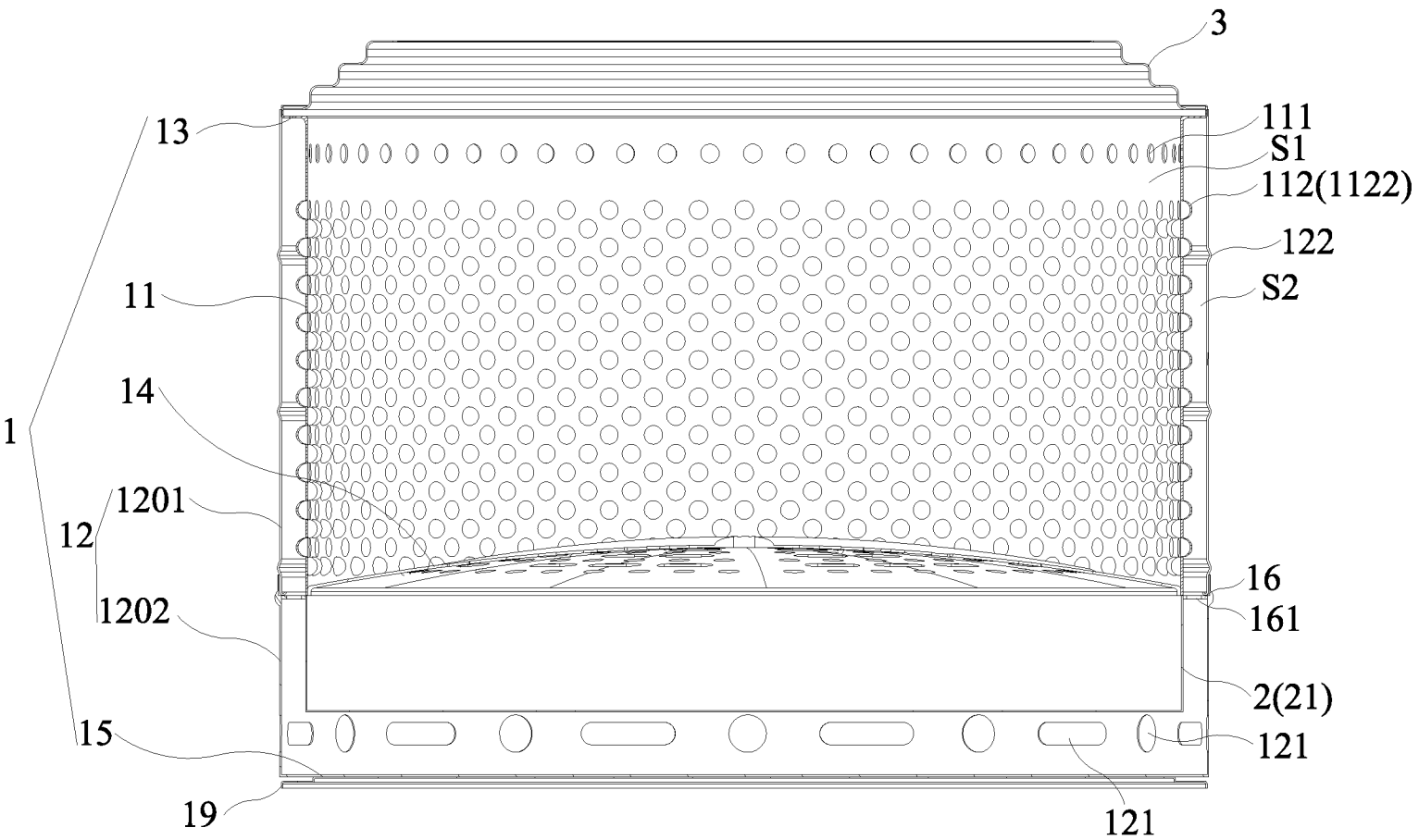
FIG. 4 is a first cross-sectional view according to the exemplary embodiment of the present invention.
Figure 5:
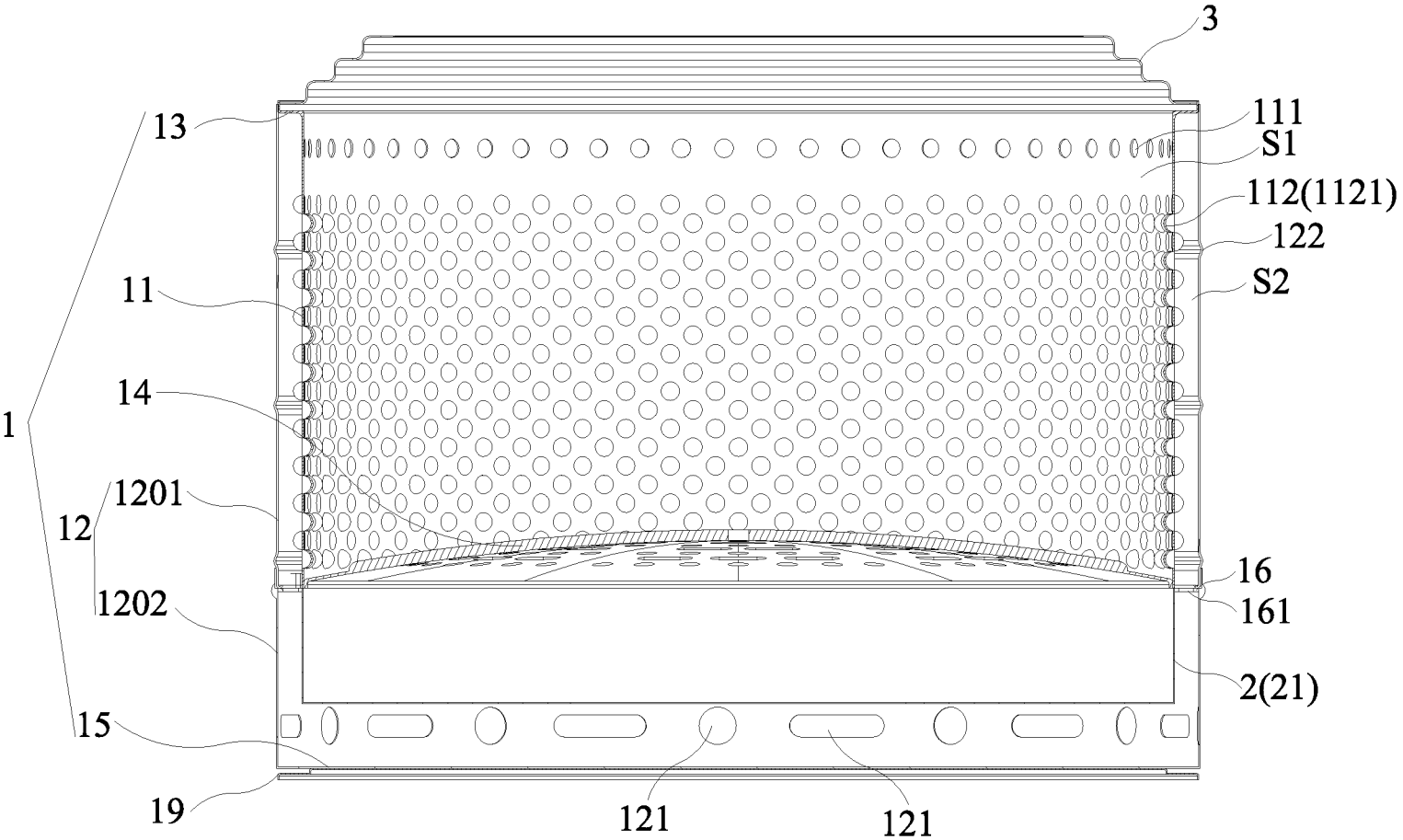
FIG. 5 is a second cross-sectional view according to the exemplary embodiment of the present invention.

As shown in FIG. 1, FIG. 4 and FIG. 5, in an exemplary embodiment of the present invention, the vortex-generating portions 112 of the main body inner wall 11 include recesses 1121 and protrusions 1122. The temperature of the vortex-generating portions 112 in the form of recesses 1121 is higher, and the heat conduction effect to the air in the air passage S2 is better. The vortex-generating portions 112 in the form of protrusions 1122 is closer to the main body outer wall 12, so that vortex-generating portions 112 in the form of protrusions 1122 and the main body outer wall have better heat radiation effect, which is beneficial to improve the warming effect on the side of the main body. Compared with the vortex-generating portions 112 in the form of recesses 1121, the vortex-generating portions 112 in the form of protrusions 1122 are more likely to cause the air in the air passage S2 to form a vortex. In addition, the vortex-generating portions 112 of the main body inner wall 11 are arranged in a multi-level structure. The vortex-generating portions 112 of two adjacent levels are arranged in a staggered manner, which is beneficial to make the air in the air passage S2 form more vortexes and further prolong the stay time of the air in the air passage.

As shown in FIG. 1, in an exemplary embodiment of the present invention, the upper main body outer wall 1201 is connected to the main body inner wall 11 through a plurality of connecting blocks 17, so as to avoid deformation of the upper main body outer wall 1201. The connecting blocks 17 are arranged at intervals to ensure that the air passes through the air passage S2. The connecting blocks 17 may be connected to the upper main body outer wall 1201 and the main body inner wall 11 by welding.

As shown in FIG. 4 and FIG. 5, in an exemplary embodiment of the present invention, the bottom of the upper main body outer wall 1201 abuts against the connecting plate 16, so that the upper main body outer wall 1201 is stably supported by the connecting plate 16. A restricting sleeve 18 is connected to the top of the lower main body outer wall 1202. The restricting sleeve 18 is fitted on the bottom of the upper main body outer wall 1201 to prevent the upper main body outer wall 1201 and the lower main body outer wall 1202 from being displaced. The restricting sleeve 18 may be integrally formed with the lower main body outer wall 1202. The upper main body outer wall 1201 may be formed with a curved reinforcing portion 122 to improve the strength of the upper main body outer wall 1201.

As shown in FIG. 6 and FIG. 7, in an exemplary embodiment of the present invention, the fire pit of the present invention is a one-piece structure after assembly. The main body inner wall 11 and the main body top plate 13 are integrally formed. The main body inner wall 11 and the main body inner bottom plate 14 are connected by welding. The main body top plate 13 and the main body outer wall 12 are connected by welding. The main body outer bottom plate and the main body outer wall 12 are connected by welding. The top peripheral edge of the ash-receiving cylinder 21 is connected to the bottom peripheral edge of the main body inner wall 11 by welding. The connecting legs 23 are connected to the ash-receiving cylinder 21 and the ash-receiving tray 22 by welding. The top peripheral edge of the ash-receiving cylinder 21 is connected to the bottom peripheral edge of the main body inner wall 11 so that the inner chamber of the ash-receiving cylinder 21 and the air passage S2 are independent of each other. The vortex-generating portions 112 of the main body inner wall 11 are in the form of protrusions 1122.

As shown in FIG. 6 and FIG. 7, in an exemplary embodiment of the present invention, the fire pit of the present invention further comprises an adjusting ring 4. The adjusting ring 4 is rotatably sleeved on the main body outer wall 12. The adjusting ring 4 has a plurality of adjusting holes 41. The adjusting holes 41 of the adjusting ring 4 are movably aligned with the air inlets 121 of the main body outer wall 12, respectively. In the present invention, the overlapping area of the adjusting hole 41 and the air inlet 121 is adjusted by rotating the adjusting ring 4 for adjusting the flow rate of the air entering the air passage S2, so as to adjust the bunting rate of the fuel in the combustion chamber S1.

It should be noted in the present invention that the vortex-generating portions 112 of the main body inner wall 11 of the present invention include at least one of the recesses 1121 and the protrusions 1122 for the air in the air passage S2 to form a vortex. In addition, the vortex-generating portions 112 of the main body inner wall 11 may be arranged all over the main body inner wall 11. The vortex-generating portions 112 of the main body inner wall 11 may be only arranged on the upper portion of the main body inner wall 11. When the vortex-generating portions 112 of the main body inner wall 11 are only arranged on the upper portion of the main body inner wall 11, the temperature difference between the temperature of the upper portion of the air passage S2 and the temperature of the lower portion of the air passage S2 is larger. The convection effect in the air passage S2 is stronger, so that the air flow velocity at the air inlets 121 is faster and the air flow in the air passage S2 is further increased. The amount of air entering into the combustion chamber S1 is increased to further improve the combustion efficiency. In the present invention, the length of the vortex-generating portion 112 may be 5-15 mm, and the width of the vortex-generating portion 112 may be 5-15 mm. The depth of the recess or protrusion of the vortex-generating portion 112 may be 3-6 mm. The vortex-generating portions 112 may be arranged into multiple levels. The number of levels of the vortex-generating portions 112 may be 15-30 levels. The number of the vortex-generating portions 112 of each level may be 50-80. The shape of the vortex-generating portion 112 may be various shapes, such as spherical, conical, etc. The diameter of the air inlet 121 may be 10-20 mm. The number of the air inlets 121 is 40 to 70, and the air inlets 121 are arranged in a circle. The distance between the air inlets 121 and the bottom of the main body outer wall 12 is 5-20 mm. The diameter of the air vent 111 may be 8-16 mm. The number of the air vents 111 is 60-90, and the air vents 111 are arranged in a circle. The distance between the air vents 111 and the top of the main body inner wall 11 is 5-15 mm.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A fire pit, comprising a main body and an ash-receiving device, wherein the main body has a main body inner wall, a main body outer wall disposed outside the main body inner wall, and a main body top plate connecting a top peripheral edge of the main body inner wall and a top peripheral edge of the main body outer wall;

wherein the main body outer wall includes an upper main body outer wall and a lower main body outer wall that are detachably connected, wherein the ash-receiving device includes an ash-receiving cylinder with an upper opening;

wherein the ash-receiving cylinder is connected to the lower main body outer wall through an annular connecting plate;

wherein the annular connecting plate has a plurality of air holes, wherein a combustion chamber is formed inside the main body inner wall;

wherein an air passage is formed among the main body inner wall, the main body outer wall and the main body top plate, a top and a peripheral side of the air passage being closed;

wherein a lower portion of the main body outer wall has a plurality of air inlets communicating with the air passage;

wherein an upper portion of the main body inner wall has a plurality of air vents communicating with the air passage and the combustion chamber, the air vents being located higher than the air inlets; and wherein an outer surface of the main body inner wall has a plurality of vortex-generating portions.

2. The fire pit as claimed in claim 1, wherein the vortex-generating portions include at least one of recesses and protrusions.

3. The fire pit as claimed in claim 2, further comprising an adjusting ring; the adjusting ring being rotatably sleeved on the main body outer wall, the adjusting ring having a plurality of adjusting holes, the adjusting holes of the adjusting ring being movably aligned with the air inlets of the main body outer wall, respectively.

4. The fire pit as claimed in claim 2, further comprising a top cover, the top cover being a hollow structure, the top cover having an upper opening and a lower opening, the upper opening having a diameter less than that of the lower opening, a bottom of the top cover abutting against the main body top plate.

5. The fire pit as claimed in claim 1, wherein the main body further includes a main body inner bottom plate and a main body outer bottom plate; the main body inner wall and the main body outer wall each have a ring shape, the main body outer wall is sleeved on the main body inner wall, the main body inner bottom plate is connected to a bottom peripheral edge of the main body inner wall, the main body outer bottom plate is connected to a lower peripheral edge of the main body outer wall, the combustion chamber is formed between the main body inner wall and the main body inner bottom plate, and the air passage is formed among the main body outer wall, the main body inner wall, the main body top plate and the main body outer bottom plate.

6. The fire pit as claimed in claim 5, wherein the ash-receiving cylinder being accommodated in the main body and located between the main body inner bottom plate and the main body outer bottom plate, an inner chamber of the ash-receiving cylinder and the air passage being independent of each other; and wherein the main body inner bottom plate having a plurality of perforations; the inner chamber of the ash-receiving cylinder communicating with the combustion chamber via the perforations.

7. The fire pit as claimed in claim 6, wherein the ash-receiving device further includes an ash-receiving tray with an upper opening, the ash-receiving tray is accommodated in the ash-receiving cylinder, and the ash-receiving tray is suspended relative to the ash-receiving cylinder.

8. The fire pit as claimed in claim 7, wherein an outer side of the ash-receiving tray is connected to an inner side of the ash-receiving cylinder through a plurality of connecting legs.

9. The fire pit as claimed in claim 6, wherein the ash-receiving cylinder is suspended relative to the main body outer bottom plate.

10. The fire pit as claimed in claim 6, wherein the lower main body outer wall has the air inlets.

11. The fire pit as claimed in claim 10, wherein the upper main body outer wall is connected to the main body inner wall through a plurality of connecting blocks, and the connecting blocks are arranged at intervals.

12. The fire pit as claimed in claim 10, wherein a bottom of the upper main body outer wall abuts against the connecting plate; a restricting sleeve is connected to a top of the lower main body outer wall, and the restricting sleeve is fitted on the upper main body outer wall.

13. The fire pit as claimed in claim 10, wherein the upper main body outer wall is formed with a curved reinforcing portion.

14. The fire pit as claimed in claim 10, wherein a top peripheral edge of the ash-receiving cylinder abuts against a bottom peripheral edge of the main body inner wall.

15. The fire pit as claimed in claim 6, wherein a top peripheral edge of the ash-receiving cylinder is connected to a bottom peripheral edge of the main body inner wall.

* * * * *